US010637180B1

(12) United States Patent
He et al.

(10) Patent No.: US 10,637,180 B1
(45) Date of Patent: Apr. 28, 2020

(54) WATER-PROTECTED AND DUST-PROOF HSD CONNECTOR

(71) Applicant: Richard Adam Norwitt, Shen Zhen (CN)

(72) Inventors: Danren He, Shen Zhen (CN); Kui Cai, Shen Zhen (CN)

( * ) Notice: Subject to any disclaimer, the term of this patent is extended or adjusted under 35 U.S.C. 154(b) by 0 days.

(21) Appl. No.: 16/418,175

(22) Filed: May 21, 2019

(51) Int. Cl.
*H01R 13/52* (2006.01)
*H01R 13/627* (2006.01)
*H01R 13/506* (2006.01)

(52) U.S. Cl.
CPC ..... *H01R 13/5219* (2013.01); *H01R 13/506* (2013.01); *H01R 13/521* (2013.01); *H01R 13/5202* (2013.01); *H01R 13/6272* (2013.01)

(58) Field of Classification Search
CPC ..... H01R 13/5219; H01R 13/5202; H01R 13/521; H01R 13/506; H01R 13/6272
USPC ..... 439/271, 272
See application file for complete search history.

(56) References Cited

U.S. PATENT DOCUMENTS 7,033,193 B2 * 4/2006 Higgins ..... H01R 13/5219 439/277
7,195,505 B1 * 3/2007 Becker ..... H01R 13/5219 439/271
8,147,272 B2 * 4/2012 Rhein ..... H01R 13/5202 439/556
2009/0275226 A1 * 11/2009 Chen ..... H01R 13/5202 439/271
2013/0341906 A1 * 12/2013 Lehmann ..... F16L 37/22 285/33
2015/0266129 A1 * 9/2015 Ihde ..... B23K 9/173 219/137.63
2015/0288090 A1 * 10/2015 Shigeta ..... H01R 13/5202 439/587

* cited by examiner

*Primary Examiner* — Harshad C Patel

(57) ABSTRACT

The present invention relates to an HSD connector comprising a male connector and a female connector; a male end main body assembly includes a male end main body and an exterior sealing ring; a male end terminal assembly includes a male end terminal, a male end terminal protector and a male end terminal sealing ring; an exterior sealing ring is mounted on a mating end of the male end main body; a male end terminal protector is mounted on a periphery of the male end terminal; a male end terminal sealing ring is mounted at a juncture at the ends of the male end protector and the male end main body; a die cast component assembly includes a die cast component main body and a die cast component sealing ring; a die cast component sealing ring is mounted on a mating area of the die cast component main body and the male end main body; a front sealing ring is mounted outside of the female end main body. The present invention provides a water- and dust-proof connector with an optimized structure by disposing eight layers of protection and adopting five hardening measures.

10 Claims, 5 Drawing Sheets

WATER-PROTECTED AND DUST-PROOF HSD CONNECTOR

BACKGROUND OF THE INVENTION

1. Field of the Invention

The present invention relates to an HSD connector and particularly to a water-protected and dust-proof HSD connector.

2. Description of Related Art

HSD (High speed data) connectors are widely used in communication and on vehicles for high speed signal and electric current transmission.

Existing HSD connectors fall short of meeting the water- and dust-proof requirements of Ingress Protection standards and are prone to functional breakdown when operating in environment with high humidity and coarse dust.

SUMMARY OF THE INVENTION

It is an objective of the present invention to overcome the flaws in current technology by providing an HSD connector with an optimized structure, particularly through sealing and hardening, to meet the water- and dust-proof requirements of Ingress Protection standards.

The technical solutions are as follows: an HSD connector comprising a male connector and a female connector;

The male connector and the female connector may be mated;

The male connector includes a male end main body assembly, a male end terminal assembly and a die cast component assembly;

The female connector includes a female end main body assembly, a female end terminal assembly and a shield assembly;

The male end terminal assembly is plugged into the die cast component assembly; the combination of the male end teiininal assembly and die cast component assembly is crimped into the male end main body assembly;

The female end terminal assembly and the shield assembly are plugged into the female end main body assembly;

The male end main body assembly includes a male end main body and an exterior sealing ring;

The male end terminal assembly includes a male end terminal, a male end terminal protector and a male end terminal sealing ring;

The exterior sealing ring is mounted on a mating end of the male end main body;

The male end terminal protector is mounted on a periphery of the male end terminal;

The male end terminal sealing ring is mounted at a juncture at the ends of the male end protector and the male end main body;

The die cast component assembly includes a die cast component main body and a die cast component sealing ring; the die cast component sealing ring is mounted on a mating area of the die cast component main body and the male end main body;

The female end terminal assembly and the shield assembly are plugged into the female end main body assembly;

The female end main body assembly is made of rubber and includes a female end main body and a front sealing ring; the front sealing ring is mounted outside of the female end main body.

When the male connector and the female connector are mated, the male end terminal assembly is plugged into the female end terminal assembly; the exterior sealing ring and the front sealing ring are located on a mating area of the male connector and the female connector.

Preferably, the die cast component main body includes a mating body; the mating body is crimped into the male end main body; the die cast component sealing ring is mounted on a mating area of the mating body and the male end main body.

Preferably, the male end terminal protector includes a first male end terminal protector and a second male end terminal protector; the first male end terminal protector is mounted on a periphery of the male end terminal; the second male end terminal protector is mounted on a periphery of the first male end terminal protector; the male end terminal sealing ring is mounted at a juncture at the ends of the second male end terminal protector and the male end main body.

Preferably, the female end main body assembly includes a rear sealing ring and a rear sealing cap.

The rear sealing ring is mounted inside the rear sealing cap and presses tightly a distal mating end of the female end main body assembly via the rear sealing cap.

Preferably, the female end terminal assembly includes a first female end terminal protector and a second female end terminal protector; the first female end terminal protector is of a tubular shape; the second female end terminal protector is of a tubular shape with an opening side wall.

The shield assembly is made of metal and includes an external shield member and an internal shield member.

The external shield member is of a tubular shape; the internal shield member is of a strip shape with a cross-shaped cross section.

The external shield member is mounted on a periphery of the first female end terminal protector.

The internal shield member is plugged into an internal cavity of the first female end terminal protector.

Preferably, one end of the male end terminal protrudes from the male end main body; waterproof adhesive is applied on the end where the male end terminal protrudes from the male end main body.

Preferably, the die cast component assembly includes a die cast component rear cap; the die cast component rear cap is crimped on a distal mating end of the die cast component main body.

Preferably, the shield assembly includes a ring member; the ring member is mounted on the internal shield member and a mating end of an internal cavity of the first female end terminal protector.

Preferably, the male end main body includes a recess and the female end main body includes a first clamping knot; when the male connector and the female connector are mated, the recess and the first clamping knot firmly clamp each other.

Preferably, on the female end main body are disposed a second clamping knot, and in an inside of the rear sealing cap is disposed a clamping slot; when the female end main body and the rear sealing ring are assembled, the second clamping knot and the clamping slot firmly clamp each other.

Preferably, on the female end main body are disposed a push plate and a push strip, and on the push plate are disposed anti-skid marks; one end of the push plate is designed as an extensible push strip that bends upwards.

The push plate is used for pushing the first clamping knot to engage or disengage with the recess on the male end main body.

Preferably, on the external shield member is disposed a clamping tongue that rises outwards, and on an inner side of the female end main body is disposed a second clamping slot; when the external shield member is plugged into the female end main body, the clamping tongue and the second clamping slot firmly clamp each other.

On an inner side of the external shield member is disposed a clamping knot, and on the first female end terminal protector is disposed a clamping slot; when the first female end terminal protector is plugged into the external shield member, the clamping knot firmly clamp the clamping slot. The terminal is secured in the external shield member. Such double clamping better secures the external shield member and the terminal in the main body.

Preferably, on the first female end terminal protector is disposed a terminal clamping strip, and on the second female end terminal protector is disposed a terminal slot; when the first female end terminal protector and the second female end terminal protector are clamped together, the terminal clamping strip is clamped into the terminal slot.

Preferably, at an end of the first male end terminal protector is disposed a skewed slot that rises outwards, and at an end of the male end terminal is disposed a bending end having a same curvature as the skewed slot; when the male end terminal is installed in the first male end terminal protector, the bending end may be plugged into the skewed slot and firmly clamped; the male end terminal is thus secured firmly.

The advantages of the foregoing technical solutions are:

Compared with existing technical solutions, the present invention provides a water- and dust-proof connector with an optimized structure by disposing eight layers of protection: 1. an exterior sealing ring is mounted on a mating end of the male end main body; 2. a male end terminal protector is mounted on a periphery of the male end terminal; 3. a male end terminal sealing ring is mounted at a juncture at the ends of the male end protector and the male end main body; 4. a die cast component sealing ring is mounted on a mating area of the die cast component main body and the male end main body; 5. a front sealing ring is mounted outside of the female end main body; 6. a die cast component rear cap is crimped on a distal mating end of the die cast component main body; 7. the end where the male end terminal protrudes from the male end main body is sealed with waterproof adhesive; 8. a rear sealing ring is mounted inside the rear sealing cap and presses tightly a distal mating end of the female end main body assembly via the rear sealing cap. When the male connector and the female connector are mated, the male end terminal assembly is plugged into the female end terminal assembly; the exterior sealing ring and the front sealing ring are located on a mating area of the male connector and the female connector.

Beside the use of sealing for protection, five hardening measures are adopted: 1. the recess and the first clamping knot firmly clamp each other to secure the mating of the male connector and the female connector; 2. the second clamping knot and the clamping slot firmly clamp each other to ensure the female end main body and the rear sealing ring are securely assembled; 3. the clamping tongue and the second clamping slot firmly clamp each other to ensure the external shield member and the female end main body firmly clamp each other; the clamping knot firmly clamped the clamping slot to secure the first female end terminal protector in the external shield member. Such double clamping better secures the external shield member and the terminal in the main body; 4. the terminal clamping strip is clamped into the terminal slot to ensure the first female end terminal protector and the second female end terminal protector firmly clamp each other; 5. when the male end terminal is installed in the first male end terminal protector, the bending end may be plugged into the skewed slot and firmly clamped to secure the male end terminal.

DETAILED DESCRIPTION OF THE PREFERRED EMBODIMENTS

The present invention will be fully understood from the detailed description given herein below and the accompanying drawings which are given by way of illustration only, and thus are not limitative of the present invention.

Embodiment 1

Figure 1:
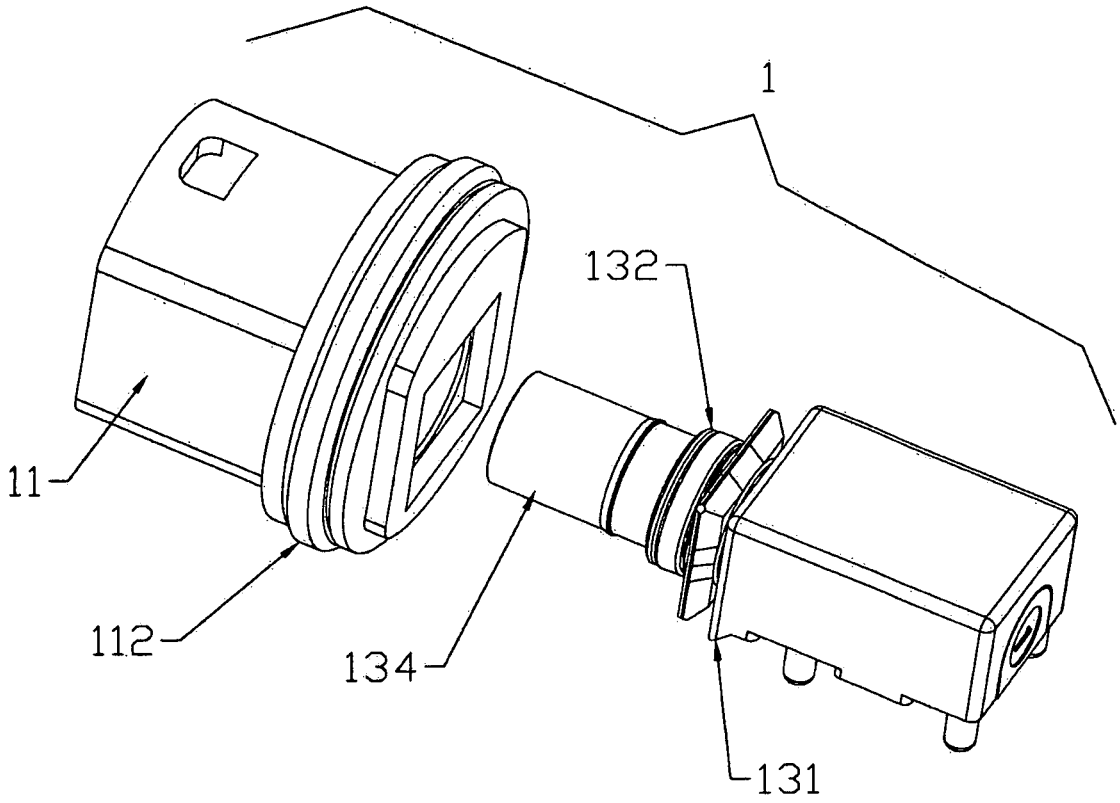
FIG. 1 is an assembly perspective view of a male connector of an HSD connector according to the present invention.
Figure 2:
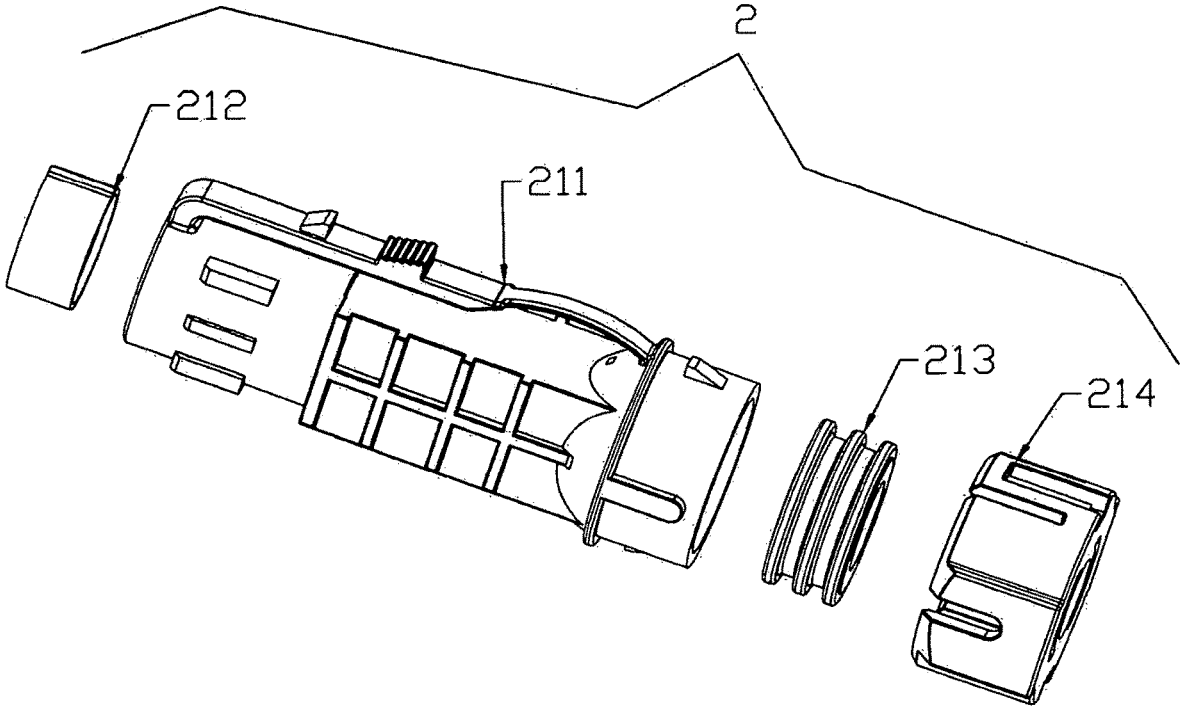
FIG. 2 is an assembly perspective view of a female connector of an HSD connector according to the present invention.
Figure 3:
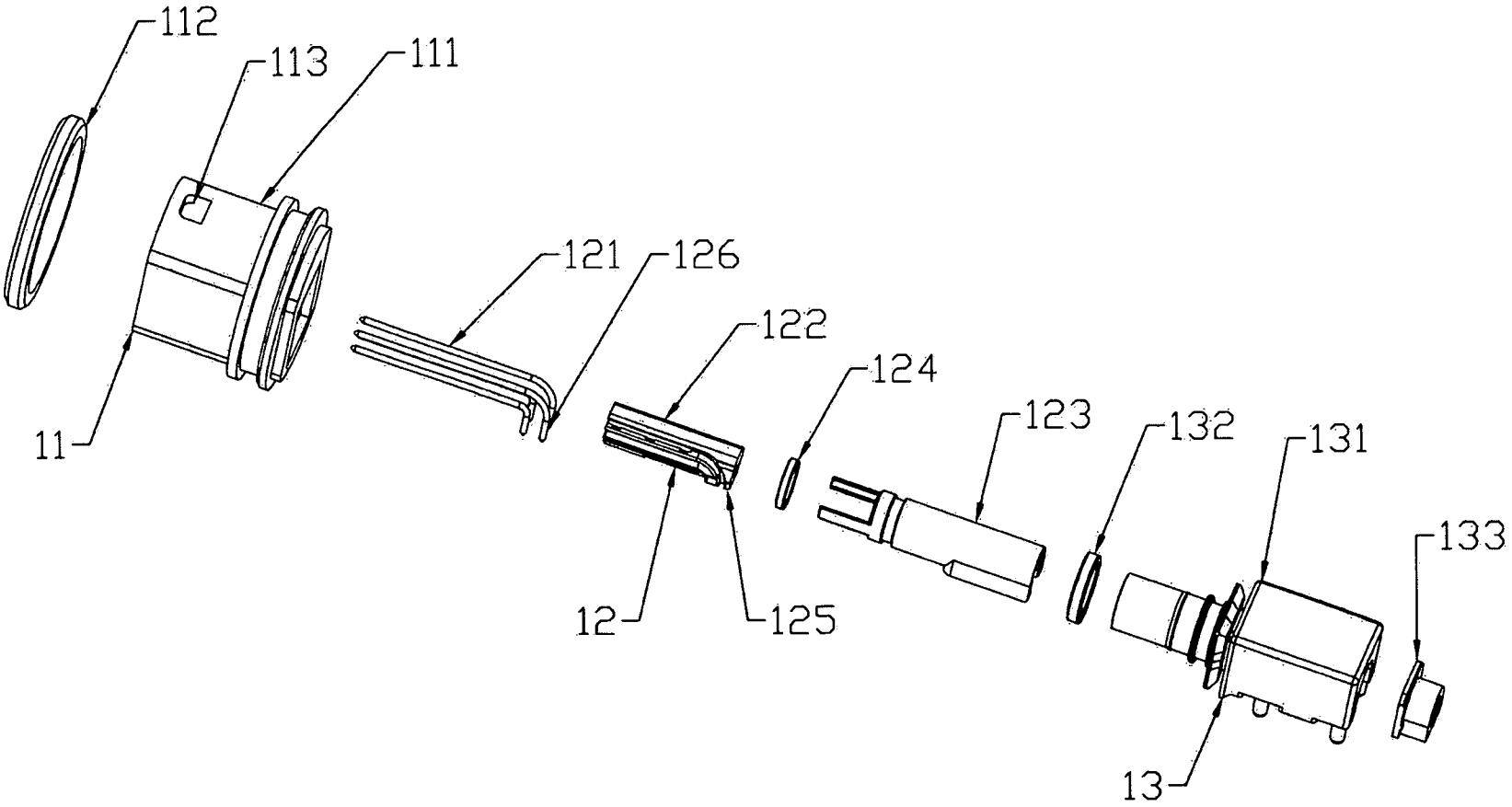
FIG. 3 is an exploded view of a male connector of an HSD connector according to the present invention.
Figure 4:
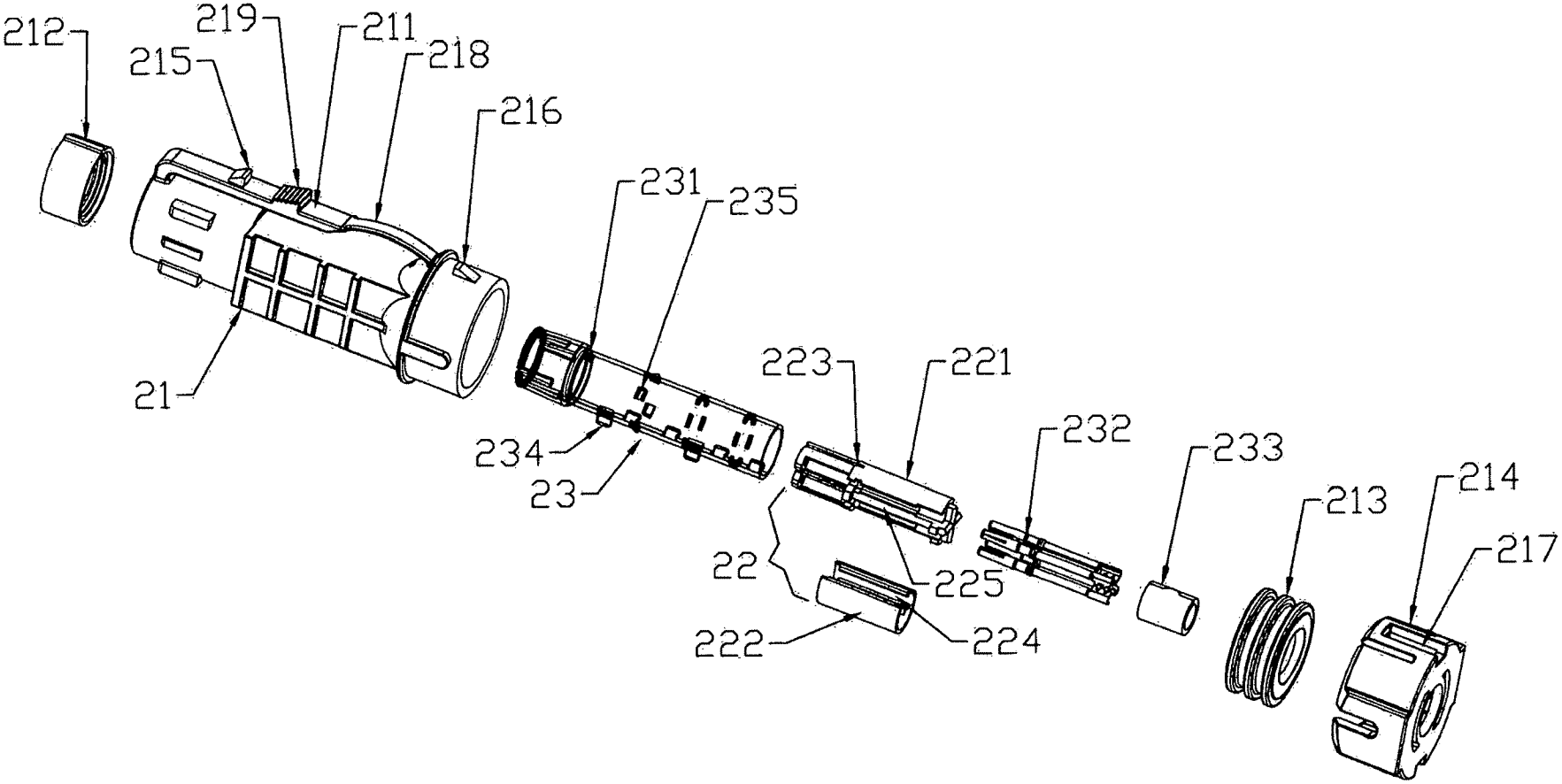
FIG. 4 is an exploded view of a female connector of an HSD connector according to the present invention.

An HSD connector comprising a male connector 1 and a female connector 2, wherein the male connector and female connector may be mated;

As FIGS. 1 and 3 show, the male connector 1 includes a male end main body assembly 11, a male end terminal assembly 12 and a die cast component assembly 13;

As FIGS. 2 and 4 show, the female connector 2 includes a female end main body assembly 21, a female end terminal assembly 22 and a shield assembly 23;

The male end terminal assembly 12 is plugged into the die cast component assembly 13; the combination of the male end terminal assembly 12 and die cast component assembly 13 is crimped into the male end main body assembly 11;

The female end terminal assembly 22 and the shield assembly 23 are plugged into the female end main body assembly 21;

The male end main body assembly 11 includes a male end main body 111 and an exterior sealing ring 112;

The male end terminal assembly 12 includes a male end terminal 121, a male end terminal protector and a male end terminal sealing ring 124;

The exterior sealing ring 112 is mounted on a mating end of the male end main body 111;

The male end terminal protector is mounted on a periphery of the male end terminal 121;

The male end terminal sealing ring 124 is mounted at a juncture at the ends of the male end protector and the male end main body 111;

The die cast component assembly 13 includes a die cast component main body 131 and a die cast component sealing ring 132; the die cast component sealing ring 132 is mounted on a mating area of the die cast component main body 131 and the male end main body 111;

The female end terminal assembly 22 and the shield assembly 23 are plugged into the male end main body assembly 21;

The female end main body assembly 21 is made of rubber and includes a female end main body 211 and a front sealing ring 212; the front sealing ring 212 is mounted outside of the female end main body 211.

When the male connector 1 and the female connector 2 are mated, the male end terminal assembly 12 is plugged into the female end terminal assembly 22; the exterior sealing ring 112 and the front sealing ring 212 are located on a mating area of the male connector 1 and the female connector 2.

Embodiment 2

Building upon the foregoing embodiment, as FIG. 3 shows, the die cast component main body 131 includes a mating body 134; the mating body 134 is crimped into the male end main body 111; the die cast component sealing ring 132 is mounted on a mating area of the mating body 134 and the male end main body 11.

Embodiment 3

Building upon the foregoing embodiments, as FIG. 3 shows, the male end terminal protector includes a first male end terminal protector 122 and a second male end terminal protector 123; the first male end terminal protector 122 is mounted on a periphery of the male end terminal 121; the second male end terminal protector 123 is mounted on a periphery of the first male end terminal protector 122; the male end terminal sealing ring 124 is mounted at a juncture at the ends of the second male end terminal protector 123 and the male end main body 111.

Embodiment 4

Building upon the foregoing embodiments, as FIG. 4 shows, the female end main body assembly 21 includes a rear sealing ring 213 and a rear sealing cap 214;

The rear sealing ring 213 is mounted inside the rear sealing cap 214 and presses tightly a distal mating end of the female end main body assembly 21 via the rear sealing cap 214.

Embodiment 5

Building upon the foregoing embodiments, as FIG. 4 shows, the female end terminal assembly 22 includes a first female end terminal protector 221 and a second female end terminal protector 222; the first female end terminal protector 221 is of a tubular shape; the second female end terminal protector 222 is of a tubular shape with an opening side wall;

The shield assembly 23 is made of metal and includes an external shield member 231 and an internal shield member 232;

The external shield member 231 is of a tubular shape; the internal shield member 232 is of a strip shape with a cross-shaped cross section;

The external shield member 231 is mounted on a periphery of the first female end terminal protector 221;

The internal shield member 232 is plugged into an internal cavity of the second female end terminal protector 221;

Embodiment 6

Figure 5:
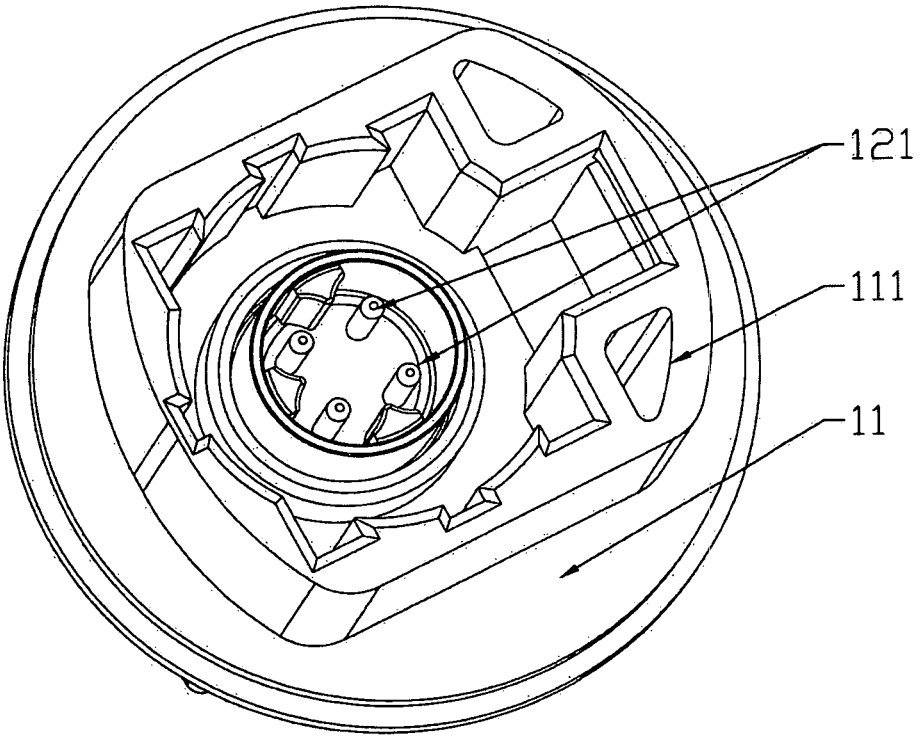
FIG. 5 is a view of a mating area of the male end terminal, where waterproof adhesive is applied.

Building upon the foregoing embodiments, as FIG. 5 shows, one end of the male end terminal 121 protrudes from the male end main body 111; waterproof adhesive is applied on the end where the male end terminal 121 protrudes from the male end main body 111.

Embodiment 7

Building upon the foregoing embodiments, as FIG. 3 shows, the die cast component assembly 13 includes a die cast component rear cap 133; the die cast component rear cap 133 is crimped on a distal mating end of the die cast component main body 131.

Embodiment 8

Building upon the foregoing embodiments, as FIG. 4 shows, the shield assembly 23 includes a ring member 233; the ring member 233 is mounted on the internal shield member 232 and a mating end of an internal cavity of the first female end terminal protector 221.

Embodiment 9

Building upon the foregoing embodiments, as FIG. 3 shows, the male end main body 111 includes a recess 113 and the female end main body 211 includes a first clamping knot 215; when the male connector 1 and the female connector 2 are mated, the recess 113 and the first clamping knot 215 firmly clamp each other.

Embodiment 10

Building upon the foregoing embodiments, as FIG. 4 shows, on the female end main body 211 is disposed a second clamping knot 216, and in an inside of the rear sealing cap 214 is disposed a clamping slot 217; when the female end main body 211 and the rear sealing ring 214 are assembled, the second clamping knot 216 and the clamping slot 217 firmly clamp each other.

Embodiment 11

Building upon the foregoing embodiments, as FIG. 4 shows, on the female end main body 211 is disposed a push plate 218 and a push strip 219, and on the push plate 218 is disposed anti-skid marks; one end of the push plate 219 is designed as an extensible push strip 219 that bends upwards.

The push plate 219 is used for pushing the first clamping knot 215 to engage or disengage with the recess 113 on the male end main body 111.

Embodiment 12

Building upon the foregoing embodiments, as FIG. 4 shows, on the external shield member 231 is disposed a clamping tongue 234 that rises outwards, and on an inner side of the female end main body 211 is disposed a second clamping slot; when the external shield member 231 is plugged into the female end main body 211, the clamping tongue 234 and the second clamping slot firmly clamp each other;

On an inner side of the external shield member 231 is disposed a clamping knot 235, and on the first female end terminal protector 221 is disposed a clamping slot 223; when the first female end terminal protector 221 is plugged into the external shield member 231, the clamping knot 235 firmly clamp the clamping slot 223.

The terminal is secured in the external shield member 231. Such double clamping better secures the external shield member 231 and the terminal in the main body.

Embodiment 13

Building upon the foregoing embodiments, as FIG. 4 shows, on the first female end terminal protector 221 is disposed a terminal clamping strip 225, and on the second female end terminal protector 222 is disposed a terminal slot 224; when the first female end terminal protector 221 and the second female end terminal protector 222 are firmly clamped together, the terminal clamping strip 225 is clamped into the terminal slot 224.

Embodiment 14

Building upon the foregoing embodiments, as FIG. 3 shows, at an end of the first male end terminal protector 122 is disposed a skewed slot 125 that rises outwards, and at an end of the male end terminal 121 is disposed a bending end 126 having a same curvature as the skewed slot 125; when the male end terminal 121 is installed in the first male end terminal protector 122, the bending end 126 may be plugged into the skewed slot 125 and firmly clamped; the terminal is thus secured firmly.

The foregoing preferred embodiments of the present invention are illustrated of the present invention rather than limiting of the present invention. It is intended to cover various modifications and changes included within the spirit and scope of the appended claims, the scope of which should be accorded the broadest interpretation so as to encompass all such modifications and similar structures.

What is claimed is:

1. A High Speed Data connector comprising a male connector and a female connector; wherein the male connector and the female connector configure to be mated;

the male connector includes a male end main body assembly, a male end terminal assembly and a die cast component assembly;

the female connector includes a female end main body assembly, a female end terminal assembly and a shield assembly;

the male end terminal assembly is plugged into the die cast component assembly;

the male end terminal assembly and die cast component assembly are crimped into the male end main body assembly;

the female end terminal assembly and the shield assembly are plugged into the female end main body assembly;

the male end main body assembly includes a male end main body and an exterior sealing ring;

the male end terminal assembly includes a male end terminal, a male end terminal protector and a male end terminal sealing ring;

the exterior sealing ring is mounted on a mating end of the male end main body;

the male end terminal protector is mounted on a periphery of the male end terminal; the male end terminal sealing ring is mounted at a juncture at the ends of the male end protector and the male end main body;

the die cast component assembly includes a die cast component main body and a die cast component sealing ring; the die cast component sealing ring is mounted on a mating area of the die cast component main body and the male end main body;

the female end terminal assembly and the shield assembly are plugged into the female end main body assembly; the female end main body assembly is made of rubber and includes a female end main body and a front sealing ring; the front sealing ring is mounted outside of the female end main body;

when the male connector and the female connector are mated, the male end terminal assembly is plugged into the female end terminal assembly; the exterior sealing ring and the front sealing ring are located on a mating area of the male connector and the female connector;

the die cast component main body includes a mating body; the mating body is crimped into the male end main body; the die cast component sealing ring is mounted on a mating area of the mating body and the male end main body;

the male end terminal protector includes a first male end terminal protector and a second male end terminal protector; the first male end terminal protector is mounted on a periphery of the male end terminal; the second male end terminal protector is mounted on a periphery of the first male end terminal protector; the male end terminal sealing ring is mounted at a juncture at the ends of the second male end terminal protector and the male end main body;

the female end main body assembly includes a rear sealing ring and a rear sealing cap; the rear sealing ring is mounted inside the rear sealing cap and presses tightly a distal mating end of the female end main body assembly via the rear sealing cap;

one end of the male end terminal protrudes from the male end main body; waterproof adhesive is applied on the end where the male end terminal protrudes from the male end main body.

2. An HSD connector of claim 1, wherein the female end terminal assembly includes a first female end terminal protector and a second female end terminal protector; the first female end terminal protector is of a tubular shape; the second female end terminal protector is of a tubular shape with an opening side wall;

the shield assembly is made of metal and includes an external shield member and an internal shield member; the external shield member is of a tubular shape; the internal shield member is of a strip shape with a cross-shaped cross section; the external shield member is mounted on a periphery of the first female end terminal protector; the internal shield member is plugged into an internal cavity of the first female end terminal protector.

3. An HSD connector of claim 1, wherein the die cast component assembly includes a die cast component rear cap; the die cast component rear cap is crimped on a distal mating end of the die cast component main body.

4. An HSD connector of claim 1, wherein the shield assembly includes a ring member; the ring member is mounted on the internal shield member and a mating end of an internal cavity of the first female end terminal protector.

5. An HSD connector of claim 1, wherein the male end main body includes a recess and the female end main body includes a first clamping knot; when the male connector and the female connector are mated, the recess and the first clamping knot firmly clamp each other.

6. An HSD connector of claim 1, wherein on the female end main body is disposed a second clamping knot, and in an inside of the rear sealing cap is disposed a clamping slot;

when the female end main body and the rear sealing ring are assembled, the second clamping knot and the clamping slot firmly clamp each other.

7. An HSD connector of claim 1, wherein on the female end main body are disposed a push plate and a push strip, and on the push plate are disposed anti-skid marks; one end of the push plate is designed as an extensible push strip that bends upwards.

8. An HSD connector of claim 1, wherein on an inner side of the external shield member is disposed a clamping knot, and on the first female end terminal protector is disposed a clamping slot; when the first female end terminal protector is plugged into the external shield member, the clamping knot firmly clamp the clamping slot; on the external shield member is disposed a clamping tongue that rises outwards, and on an inner side of the female end main body is disposed a second clamping slot; when the external shield member is plugged into the female end main body, the clamping tongue and the second clamping slot firmly clamp each other.

9. An HSD connector of claim 1, wherein on the first female end terminal protector is disposed a terminal clamping strip, and on the second female end terminal protector is disposed a terminal slot; when the first female end terminal protector and the second female end terminal protector are clamped together, the terminal clamping strip is clamped into the terminal slot.

10. An HSD connector of claim 1, wherein at an end of the first male end terminal protector is disposed a skewed slot that rises outwards, and at an end of the male end terminal is disposed a bending end having a same curvature as the skewed slot; when the male end terminal is installed in the first male end terminal protector, the bending end may be plugged into the skewed slot and firmly clamped.

* * * * *